US009232589B2

(12) United States Patent
Zhang et al.

(10) Patent No.: US 9,232,589 B2
(45) Date of Patent: Jan. 5, 2016

(54) LED BACKLIGHT DRIVING CIRCUIT AND METHOD FOR DRIVING THE LED BACKLIGHT DRIVING CIRCUIT

(71) Applicant: SHENZHEN CHINA STAR OPTOELECTRONICS TECHNOLOGY CO., LTD, Shenzhen (CN)

(72) Inventors: Xianming Zhang, Shenzhen (CN); Xiang Yang, Shenzhen (CN)

( * ) Notice: Subject to any disclaimer, the term of this patent is extended or adjusted under 35 U.S.C. 154(b) by 203 days.

(21) Appl. No.: 14/006,675

(22) PCT Filed: Jun. 27, 2013

(86) PCT No.: PCT/CN2013/078189
§ 371 (c)(1),
(2) Date: Sep. 22, 2013

(87) PCT Pub. No.: WO2014/201713
PCT Pub. Date: Dec. 24, 2014

(65) Prior Publication Data

US 2014/0375213 A1 Dec. 25, 2014

(30) Foreign Application Priority Data

Jun. 20, 2013 (CN) ..... 2013 1 0242543

(51) Int. Cl.
*H05B 33/08* (2006.01)

(52) U.S. Cl.
CPC ..... *H05B 33/083* (2013.01); *H05B 33/0884* (2013.01)

(58) Field of Classification Search
CPC ..... H05B 37/02; H05B 33/08; H05B 33/083; H05B 33/0884; H05B 33/0827; H05B 33/051
USPC ..... 315/122, 185 R, 186, 291, 294, 307, 308
See application file for complete search history.

(56) References Cited

U.S. PATENT DOCUMENTS

| | | | | |
|---|---|---|---|---|
| 8,664,890 | B2 * | 3/2014 | Hsieh et al. | 315/294 |
| 2009/0174338 | A1 * | 7/2009 | Muramatsu | 315/250 |

(Continued)

FOREIGN PATENT DOCUMENTS

| | | | |
|---|---|---|---|
| CN | 101534594 | A | 9/2009 |
| CN | 101916550 | A | 12/2010 |
| CN | 102026442 | A | 4/2011 |
| CN | 102054442 | A | 5/2011 |
| CN | 102548121 | A | 7/2012 |

(Continued)

OTHER PUBLICATIONS

Wang Chao, the International Searching Authority written comments, Mar. 2014, CN.

*Primary Examiner* — Thai Pham

(57) ABSTRACT

A light emitting diode (LED) backlight driving circuit includes a plurality of LED light bars, a power supply driving the LED light bars to light, and comparing units corresponding to the LED light bars one by one. A first input end of the comparing unit is coupled to a cathode end of the LED light bar, and a second input end of the comparing unit receives a first reference voltage. Each of the LED light bars is connected in series with a switching unit, an output end of the comparing unit is coupled to a statistic unit, an output end of the statistic unit is coupled to driving units corresponding to the switching units one by one and controlling the switching units to turn on/off. The statistic unit divides the LED light bars into two groups according to a logic state output by the comparing unit, and controls the driving unit to turn off one of two groups of LED light bars having a fewer number than the other group of the LED light bars.

16 Claims, 3 Drawing Sheets

(56) References Cited

U.S. PATENT DOCUMENTS

| | | | | |
|---|---|---|---|---|
| 2011/0068700 | A1 | 3/2011 | Fan | |
| 2012/0074856 | A1 | 3/2012 | Takata et al. | |
| 2013/0093327 | A1 * | 4/2013 | Lee | 315/122 |

FOREIGN PATENT DOCUMENTS

| | | | | |
|---|---|---|---|---|
| CN | 202488822 | U | * | 10/2012 |
| CN | 102956210 | A | | 3/2013 |
| KR | 20130021070 | A | | 3/2013 |

* cited by examiner

LED BACKLIGHT DRIVING CIRCUIT AND METHOD FOR DRIVING THE LED BACKLIGHT DRIVING CIRCUIT

TECHNICAL FIELD

The present disclosure relates to the field of liquid crystal displays (LCDs), and more particularly to a light emitting diode (LED) backlight driving circuit and a method for driving the LED backlight driving circuit.

BACKGROUND

A liquid crystal display (LCD) device includes a backlight driving circuit, and a backlight driving circuit that uses a light emitting diode (LED) as backlight source is called a LED backlight driving circuit. The LED backlight driving circuit includes an LED light bar and a constant current driving chip that drives the LED light bar. A typical constant current driving chip has a short-circuit protection function. A comparator is connected with a cathode end of each of the LED light bars, and the comparator compares voltage of the cathode end of each of the LED light bars with a reference voltage. If the voltage of the cathode end of the LED light bar is greater than the reference voltage, a corresponding LED light bar turns off, and if the voltage of the cathode end of the LED light bar is less than the reference voltage, the corresponding LED light bar is in normal operation.

Voltages of one or more LED light bars are great, and far exceed voltage of remaining normal LED light bars, however, the constant current driving chip turns off remaining normal LED light bars instead of turning off abnormal LED light bars.

SUMMARY

The aim of the present disclosure is to provide a light emitting diode (LED) backlight driving circuit and a method for driving the LED backlight driving circuit capable of improving reliability of short-circuit protection.

The aim of the present disclosure is achieved by the following method.

A light emitting diode (LED) backlight driving circuit comprises a plurality of LED light bars, a power supply that drives the LED light bars, and comparing units corresponding to the LED light bars one by one. A first input end of the comparing unit is coupled to a cathode end of the LED light bar, and a second input end of the comparing unit receives a first reference voltage. Each of the LED light bars is connected in series with a switching unit, and an output end of the comparing unit is coupled to a statistic unit. An output end of the statistic unit is coupled to driving units corresponding to the switching units one by one, and the driving unit controls the switching units to turn on/off. The statistic unit divides the LED light bars into two groups according to logic state output by the comparing unit, and controls the driving unit to turn off one or two groups of the LED light bars having a fewer number than the other group of the LED light bars.

Furthermore, the statistic unit comprises a counting unit that sums an output voltage of each of the comparing units, and a logical decision unit coupled to the counting unit. When a value summing the output voltage of each of the comparing units by the counting unit exceeds a preset reference value, the logical decision unit controls the driving unit to turn off one of two groups of LED light bars having a fewer number than the other group of the LED light bars. When voltages of a few LED light bars are great, and far exceed voltages of remaining normal LED light bars, most of the comparing units output a high level signal, thus a value summing voltages of the output ends of all comparing units is great, namely exceeds a reference value. The reference value is set, and when the value summing the voltages of the output ends of all comparing units exceeds the reference value, it is determined that there is an abnormal LED light bar, and the LED light bar corresponding to the comparing unit outputting the high level signal turns off.

Furthermore, the counting unit comprises an adder, and an inverter coupled to the adder. An input end of the adder is coupled to the output end of each of the comparing units, and the inverter is coupled to the logical decision unit. The statistic unit sums the output voltage of each of the comparing units through a simple adder circuit. Because the output voltage of the adder and the input voltage of the adder are opposite, the output voltage of the adder can be reversed by the inverter, which allows the logical decision unit to read and determine.

Furthermore, the adder comprises a first amplifier, each of the comparing units is coupled to an inverting input end of the first amplifier through a divider resistor, and resistance value of each of the divider resistors is same. A first resistor is connected between the inverting input end of the first amplifier and an output end of the first amplifier, and a resistance value of the first resistor is equal to a sum of resistance values of all divider resistors. The inverter comprises a second amplifier, a second resistor, and a third resistor, where resistance value of the second resistor and resistance value of the third resistor are same. The output end of the first amplifier of the adder is coupled to an inverting input end of the second amplifier through the second resistor, the third resistor is connected between the inverting input end of the second amplifier and an output end of the second amplifier, and the output end of the second amplifier is coupled to the logical decision unit. The resistance values of the divider resistors are same, and the resistance value of the first resistor is equal to the sum of the resistance values of all divider resistors, thus, the output voltage of the adder is equal to the sum of the output voltages of all comparing units according to adder theory. The resistance value of the second resistor and resistance value of the third resistor are same, and the inverter does not increase or reduce the output voltage of the adder, thus the voltage input to the logical decision unit is equal to the sum of the output voltages of all comparing units, which simplifies converting of the numerical the values, thereby reducing development time and development costs.

Furthermore, the logical decision unit comprises a first comparator, and an XOR gate corresponding to the LED light bar one by one. A first input end of the first comparator is coupled to the counting unit, and a second input end of the first comparator receives a second reference voltage. A value of the second reference voltage is equal to the preset reference value. A first input end of the XOR gate is coupled to an output end of the first comparator, a second input end of the XOR gate is coupled to the output end of the comparing unit corresponding to each of the LED light bars, and an output end of the XOR gate is coupled to each of the driving units. Most of the comparing units generally output the low level signal, thus the sum of the output voltage of all comparing units is small, and is less than the second reference voltage (namely the present reference value), the first comparator outputs the low level signal. At this time, the comparing unit corresponding to the normal LED light bar also outputs the low level signal, because the logical operations of two input signals of the XOR gate are same, the XOR gate outputs the low level signal, thus the switching unit corresponding to the normal LED light bar turns on, the LED light bar is in normal operation. When one or more LED light bar are abnormal, the voltages of the abnormal LED lights far exceed the voltages of the normal LED light bars, most of the comparing units output the high level signal, thus the sum of the output voltage of all comparing units is great, and is greater than the second reference voltage (namely the preset reference value), the first comparator outputs the high level signal. At this time, the comparing unit corresponding to the normal LED light bar also outputs the high level signal, because the logical operations of two input signals of the XOR gate are same, the XOR gate outputs the low level signal, thus the switching unit corresponding to the normal LED light bar turns on, the LED light bar is in normal operation.

Furthermore, the driving unit comprises a first controllable switch, a second controllable switch, a fourth resistor, and a fifth resistor. An input end of the first controllable switch receives a reference high level signal, a control end of the first controllable switch is coupled to a corresponding comparing unit, and an output end of the first controllable switch is connected with a ground terminal through the fourth resistor. An output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor. This is a specific circuit of the driving unit. When the XOR gate outputs the low level signal, the first controllable switch and the second controllable switch of the corresponding driving unit turn off, the switching unit receives the PWM dimming signal of the LED backlight driving circuit through the fifth resistor to dim, the corresponding LED light bar is in normal operation. When the XOR gate outputs the high level signal, the first controllable switch and the second controllable switch of the corresponding driving unit turn on, the voltage of the PWM dimming signal of the LED backlight driving circuit reduces, the corresponding switching unit is driven to turn off, and the corresponding LED light bar turns off.

Furthermore, the statistic unit comprises a counting unit that sums an output voltage of each of the comparing units, and a logical decision unit coupled to the counting unit. The counting unit comprises an adder, and an inverter coupled to the adder. An input end of the adder is coupled to the output end of each of the comparing units, and the inverter is coupled to the logical decision unit. The adder comprises a first amplifier, each of the comparing units is coupled to an inverting input end of the first amplifier through a divider resistor, and resistance value of each of the divider resistors is same. A first resistor is connected between the inverting input end of the first amplifier and an output end of the first amplifier, and a resistance value of the first resistor is equal to a sum of resistance values of all divider resistors. The inverter comprises a second amplifier, a second resistor, and a third resistor, resistance value of the second resistor and resistance value of the third resistor are same. The output end of the first amplifier of the adder is coupled to an inverting input end of the second amplifier through the second resistor, the third resistor is connected between the inverting input end of the second amplifier and an output end of the second amplifier, and the output end of the second amplifier is coupled to the logical decision unit. The logical decision unit comprises a first comparator, and an XOR gate corresponding to the LED light bar one by one. A first input end of the first comparator is coupled to the output end of the second amplifier, and a second input end of the first comparator receives a second reference voltage. A first input end of the XOR gate is coupled to an output end of the first comparator, a second input end of the XOR gate is coupled to the output end of the comparing unit corresponding to each of the LED light bars. The driving unit comprises a first controllable switch, a second controllable switch, a fourth resistor, and a fifth resistor. An input end of the first controllable switch receives a reference high level signal, a control end of the first controllable switch is coupled to a corresponding comparing unit, and an output end of the first controllable switch is connected with a ground terminal through the fourth resistor. An output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor. When an output voltage of the first amplifier is less than a preset reference value, the first comparator outputs a high level signal to control the second controllable switch corresponding to one of two groups of LED light bars having a fewer number than the other group of the LED light bars to turn on through the XOR gate. A value of the second reference voltage is equal to the preset reference value.

A light emitting diode (LED) backlight driving circuit comprises a plurality of LED light bars, a power supply that drives the LED light bars, and comparing units corresponding to the LED light bar one by one. A first input end of the comparing unit is coupled to a cathode end of the LED light bar, and a second input end of the comparing unit receives a reference voltage. Each of the LED light bars is connected in series with a switching unit, and an output end of the comparing unit is coupled to a statistic unit. An output end of the statistic unit is coupled to driving units corresponding to the switching units one by one, and the driving unit controls the switching units to turn on/off. The statistic unit divides the LED light bars into two groups according to logic state output by the comparing unit, and controls the driving unit to turn off one of two groups of LED light bars according to a preset condition.

A method for driving a light emitting diode (LED) backlight driving circuit, the LED backlight driving circuit comprises a plurality of LED light bars, a power supply that drives the LED light bars, and comparing units corresponding to the LED light bar one by one. A first input end of the comparing unit is coupled to a cathode end of the LED light bar, a second input end of the comparing unit receives a first reference voltage, and each of the LED light bars is connected in series with a switching unit. The method comprises:

A: determining logic states output by all comparing units, and dividing the LED light bars into two groups according to the logic states output by the comparing units.

B: turning off one of two groups of LED light bars having a fewer number than the other group of the LED light bars.

Furthermore, the step A comprises: summing an output voltage each of the comparing units, presetting a reference value, and comparing the reference value with a value summing the output voltage each of the comparing units through the first comparator. When the value summing the output voltage each of the comparing units exceeds the reference value, logic output by the first comparator and logic output by the one group of comparing unit having few LED light bars are same. When the value summing the output voltage each of the comparing units does not exceed the reference value, logic output by the first comparator and logic output by the one group of comparing unit having more LED light bars are same. The step B comprises: driving a corresponding switching unit after XOR operation of the logic output by the first comparator and the logic output by each of the comparing units, and turning off the one of two groups of LED light bars having a fewer number than the other group of the LED light bars. When the voltages of a few LED light bars are great, and far exceed the voltages of remaining LED light bars, most of the comparing units output a high level signal; at this time, a sum of the output voltages of all comparing units is great, namely exceeds the reference value. The reference value is set, when the sum of the output voltages of all comparing units exceeds the reference value, the logic output by the first comparator and the logic output by the one group comparing unit having few LED light bars are same, and the corresponding switching unit is driven after the XOR operation of the logic output by the first comparator and the logic output by the one group comparing unit having few LED light bars, which turns off one of two groups of LED light bars having a fewer number than the other group of the LED light bars.

It should be understood that a feedback voltage of the comparing unit coupled to the cathode end of the LED light bar is determined by the LED light bar having a maximum voltage, namely voltage of the cathode end of the LED light bar having the maximum voltage is equal to a minimum feedback voltage required by the comparing unit. An output voltage of the power supply is determined by the minimum feedback voltage, thus voltage of the cathode end of each of the remaining LED light bars is equal to a sum of the minimum feedback voltage and a difference value of between the voltage of each of the remaining LED light bars and the maximum voltage. Thus, when voltages of one or more LED light bars are great, and far exceed voltage of the remaining normal LED light bars, however the constant current driving chip turns off the remaining normal LED light bars instead of turning off abnormal light bar LED light bars.

In the present disclosure uses the statistic unit to obtain logic state output by each of the comparing units. When an output voltage of the comparing unit is at a high level, the LED light bar corresponding to the comparing unit is regarded as a first group. When the output voltage of the comparing unit is at a low level, the LED light bar corresponding to the comparing unit is regarded as a second group. The abnormal LED light bars turns off according to the preset condition. Generally, a number of the abnormal LED light bars are one or more, thus the one group of LED light bar having few LED light bars can be directly turned off. When voltages of the one or more LED light bars are great, and far exceed voltages of the remaining normal LED light bars, the comparing units corresponding to the one or more LED light bars output a low level signal, but the comparing units corresponding to the remaining normal LED light bars output a high level signal. The statistic unit can determine that a number of the LED light bars corresponding to the high level signal is more than a number of the LED light bars corresponding to the low level signal, and the driving unit controls the switching units corresponding to the abnormal few LED light bars to turn off, thereby reliably avoiding the shorten-circuit. For a common short-circuited trouble, a number of short-circuited LED light bars are few in number, thus the comparing units outputting the low level signal is few in number, the statistic unit still can reliably turn off the abnormal LED light bars.

DETAILED DISCLOSURE

Figure 1:
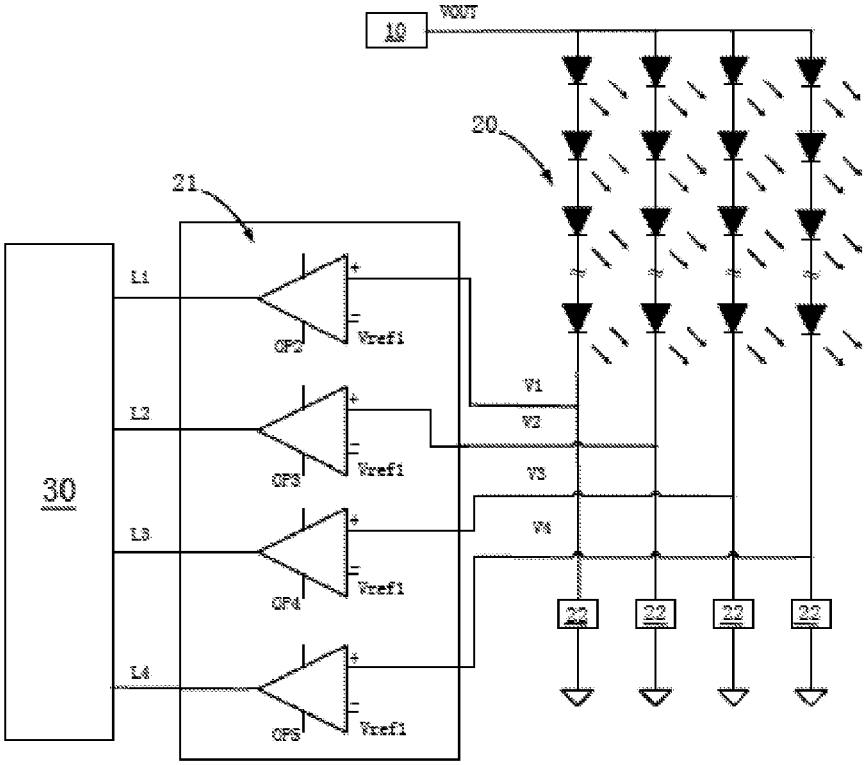
FIG. 1 is a schematic diagram of a light emitting diode (LED) backlight driving circuit of a first example of the present disclosure.

The present disclosure provides a liquid crystal display (LCD) device comprising a light emitting diode (LED) backlight driving circuit. The LED backlight driving circuit comprises a plurality of LED light bars, a power supply that drives the LED light bars, and comparing units corresponding to the LED light bars one by one. A first input end of the comparing unit is coupled to a cathode end of the LED light bar, and a second input end of the comparing unit receives a first reference voltage. Each of the LED light bars is connected in series with a switching unit, an output end of the comparing unit is coupled to a statistic unit, and an output end of the statistic unit is coupled to driving units corresponding to the switching units one by one, where the driving units controls the switching units to turn on/off. The statistic unit divides the LED light bars into two groups according to logic state output by the comparing unit, and controls the driving unit to turn off one of the two groups of LED light bars according to a preset condition. Generally, a number of abnormal LED light bars are few in number, thus, a number of the one group of LED light bars having fewer number LED light bars than other group of the LED light bars can be directly turned off.

It should be understood that a feedback voltage of the comparing unit coupled to the cathode end of the LED light bar is determined by the LED light bar having a maximum voltage, namely voltage of the cathode end of the LED light bar having the maximum voltage is equal to a minimum feedback voltage required by the comparing unit. An output voltage of the power supply is determined by the minimum feedback voltage, thus voltage of the cathode end of each of the remaining LED light bars is equal to a sum of the minimum feedback voltage and a difference value between the voltage of each of the remaining LED light bars and the maximum voltage. Thus, when voltages of one or more LED light bars are great, and far exceed voltage of the remaining normal LED light bars, the constant current driving chip turns off the remaining normal LED light bars instead of turning off abnormal LED light bars.

The present disclosure uses the statistic unit to obtain a logic state output by each of the comparing units. When an output voltage of the comparing unit is at a high level (logic 1), the LED light bar corresponding to the comparing unit is regarded as a first group. When the output voltage of the comparing unit is at a low level (logic 0), the LED light bar corresponding to the comparing unit is regarded as a second group. The abnormal LED light bars turns off according to the preset condition. Generally, a number of the abnormal LED light bars are few in number, thus a number of the one group of LED light bar having fewer number LED light bars than other groups of the LED light bars can be directly turned off. When voltages of the one or more LED light bars are great, and far exceed voltages of the remaining normal LED light bars, the comparing units corresponding to the one or more LED light bars output the low level signal, but the comparing units corresponding to the remaining normal LED light bars output the high level signal. The statistic unit can determine that a number of the LED light bars corresponding to the low level signal, and the driving unit controls the switching units corresponding to the abnormal few LED light bars to turn off, thereby reliably avoiding short-circuited trouble. For a common short-circuited trouble, a number of short-circuited LED light bars are few in number, thus the comparing units outputting the low level signal is few in number, the statistic unit still can reliably turn off the abnormal LED light bars.

Taking four LED light bars connected in parallel with each other for example, the present disclosure will further be described in detail in accordance with the figures and the exemplary examples.

Example 1

Figure 2:
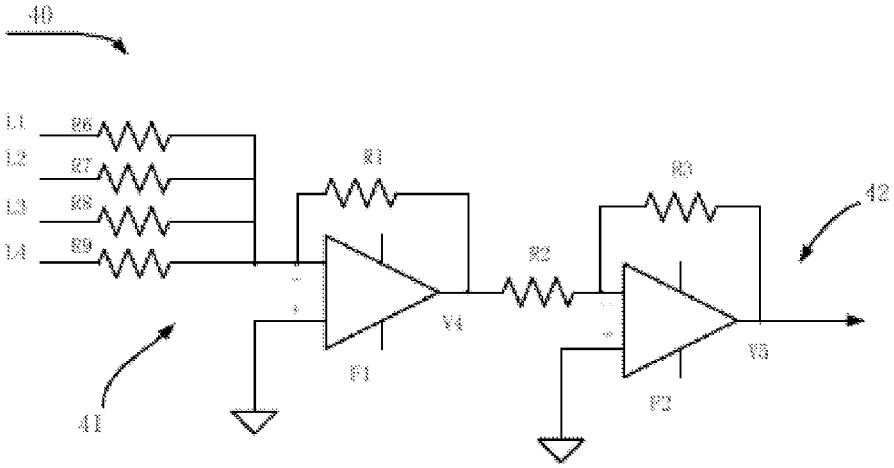
FIG. 2 is a schematic diagram of a counting unit of a statistic unit of a first example of the present disclosure.
Figure 3:
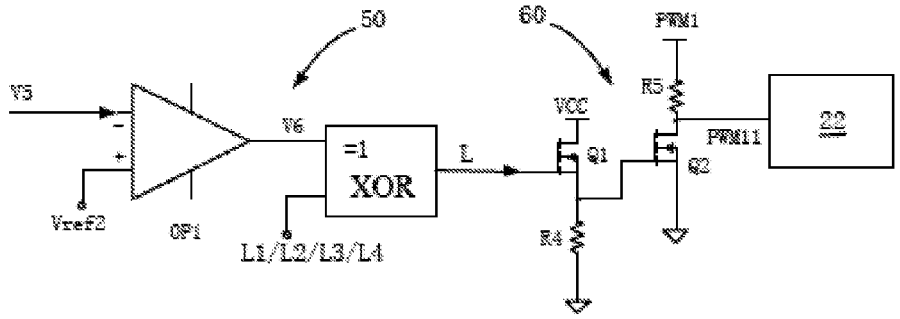
FIG. 3 is a schematic diagram of a logical decision unit of a statistic unit of a first example of the present disclosure.

As shown in FIG. 1 to FIG. 3, an LED backlight driving circuit of the present disclosure comprises a plurality of LED light bars 20, a power supply 10 driving the LED light bars 20, and comparing units 21 corresponding to the LED light bars 20 one by one (such as a comparator OP2/OP3/OP4/OP5 in FIG. 1). A first input end of the comparing unit 21 is coupled to a cathode end of the LED light bar 20, and a second input end of the comparing unit receives a first reference voltage Vref1. Each of the LED light bars is connected in series with a switching unit 22, an output end of the comparing unit 21 is coupled to a statistic unit 30, and an output end of the statistic unit 30 is coupled to driving units 60 corresponding to the switching units 22 one by one, where the driving units 60 controls the switching unit 22 to turn on/off. The statistic unit 30 comprises a counting unit 40 that sums an output voltage of each of the comparing units, and a logical decision unit 50 coupled to the counting unit 40. The counting unit 40 comprises an adder 41 and an inverter 42 coupled to the adder 41, where an input end of the adder 41 is coupled to the output end of each of the comparing units 21, and the inverter 42 is coupled to the logical decision unit 50. The adder 41 comprises a first amplifier F1, and each of the comparing units 21 is coupled to an inverting input end of the first amplifier F1 through a divider resistor (R6/R7/R8/R9 as shown in FIG. 2), wherein resistance value of each of the divider resistors is same. A first resistor R1 is connected between the inverting input end of the first amplifier F1 and an output end of the first amplifier F1, and a resistance value of the first resistor R1 is equal to a sum of the resistance values of all of the divider resistor R6, the divider resistor R7, the divider resistor R8, and the divider resistor R9. The inverter 42 comprises a second amplifier F2, a second resistor R2, and a third resistor R3, where resistance value of the second resistor R2 and resistance value of the third resistor R3 are same. The output end of the first amplifier F1 of the adder 41 is coupled to an inverting input end of the second amplifier F2 through the second resistor R2, the third resistor R3 is connected between the inverting input end of the second amplifier F2 and an output end of the second amplifier F2, and the output end of the second amplifier F2 is coupled to the logical decision unit 50. The logical decision unit 50 comprises a first comparator OP1, and an XOR gate XOR corresponding to the LED light bars 20 one by one. A first input end of the first comparator OP1 is coupled to the output end of the second amplifier F2, and a second input end of the first comparator OP1 receives a second reference voltage Vref2. A first input end of the XOR gate XOR is coupled to an output end of the first comparator OP1, and a second input end of the XOR gate XOR is coupled to the output end of the comparing unit 21 corresponding to each of the LED light bars 20. The driving unit 60 comprises a first controllable switch Q1, a second controllable switch Q2, a fourth resistor R4, a fifth resistor R5. An input end of the first controllable switch Q1 receives a reference high level signal VCC, a control end of the first controllable switch Q1 is coupled to a corresponding comparing unit 21, and an output end of the first controllable switch Q1 is connected with a ground terminal through the resistor R4. An output end of the second controllable switch Q2 is connected with the ground terminal, a control end of the second controllable switch Q2 is coupled to the output end of a corresponding first controllable switch Q1, and an input end of the second controllable switch Q2 receives a pulse-width modulation (PWM) dimming signal of the LED backlight driving circuit through the fifth resistor R5. When an output voltage of the first amplifier F1 is less than a preset reference value, the first comparator OP1 sends the high level signal to control the second controllable switch Q2 corresponding to few LED light bars to turn on by the XOR gate XOR, and the second reference voltage Vref2 is equal to the present reference value.

The adder comprises the first amplifier, and an output signal of the adder is: $-V4=R5/R1*L1+R5/R2*L2+R5/R3*L3+R5/R4*L4$, where R1, R2, R3, and R4 are equal (R1=R2=R3=R4), R5/R1=0.25 (If a number of the LED light bars changes, R5/R1 may accordingly adjust. Additionally, L1, L2, L3, and L4 are obtained from the comparator OP2, the comparator OP3, the comparator OP4, and the comparator OP5, respectively, thus only VCC and 0V are output).

The inverter comprises the second amplifier, an output signal of the inverter is: $V5/R7=-V4/R6$, where R7 is equal to R6, thus V5 is equal to −V4.

Because a number of the abnormal LED light bars are few in number, and most of comparators output 0V at a normal condition, thus, an average value of a sum of the output voltage of all comparators is generally less than 0.5 VCC. According to the above-mentioned condition, a numerical value being more than 0.5 VCC is generally used as the second reference voltage Vref2 of the first comparator, such as the Vref2 is equal to 0.6 VCC (the value of the Vref2 depends on a number of the LED light bars and a value of R5/R1). If voltage of one of the LED light bars is considerably greater than voltages of the remaining LED light bars, the first comparator outputs the low level signal (namely V6 is at the low level), and the LED light bar having great voltage is controlled to turn off. If voltages of one or two LED light bars are less than voltages of the remaining LED light bars, the first comparator outputs the high level signal, which can control to turn off the LED light bar having small voltage.

Figure 4:
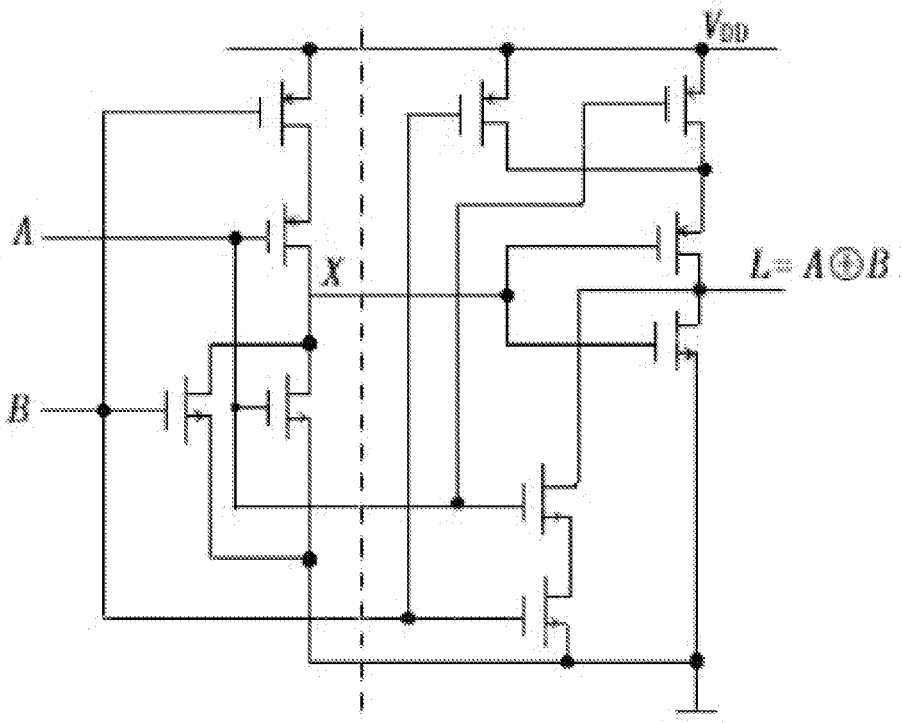
FIG. 4 is a schematic diagram of an XOR gate of a first example of the present disclosure.

A specific circuit structure of the XOR gate is shown in FIG. 4, the XOR gate comprises a plurality of metal-oxide-semiconductor field-effect transistors (MOSFETs) and one switch. When one of A and B is at the high level, the output end of the XOR gate outputs the high level signal (namely the output signal L of the XOR gate is at the high level). When the output signal L of the XOR gate is at the high level, an signal PWM11 of the input end of the second controllable switch is at the low level, which drives the switching unit to turn off, and the corresponding LED light bar turns off. If the output signal L of the XOR gate is at the low level, PWM11 is equal to PWM1 (PWM1 is the PWM dimming signal of the LED backlight driving circuit), the corresponding LED light bar is in normal operation.

A is equal to V6, and B is any one of the L1, L2, L3, and L4. Thus, when only one LED light bar is abnormal, the one abnormal LED light bar can be reliably turned off.

In the example, the LED light bars are divided into two groups by summing the voltage of the output end of each of the comparing units. When the voltages of the one or more LED light bars are great, and far exceed the voltages of the remaining normal LED light bars, most of the comparing units output the high level signal, thus a value summing the voltages of the output ends of all comparing units is great. A reference value is set, when the value summing the voltages of the output ends of all comparing units exceeds the reference value, the abnormal LED light bar is determined to exist, and the LED light bar corresponding to the comparing unit outputting the high level signal turns off.

The statistic unit comprises the counting unit and the logical decision unit, and sums the output voltage of each of the comparing units through a simple adder circuit. Because the output voltage of the adder and the input voltage of the adder are opposite, the output voltage of the adder can be reversed by the inverter, which allows the logical decision unit to read and determine. The resistance value of each of the divider resistors is same, and the resistance value of the first resistor is equal to the sum of the resistance values of all divider resistors, thus, the output voltage of the adder is equal to the sum of the output voltages of all comparing units according to adder principle. The resistance values of the second resistor and the third resistor are same, and the inverter does not increase or reduce the output voltage of the adder, thus the input voltage of the logical decision unit is equal to the sum of the output voltages of all comparing units, which simplifies converting of the numerical values, thereby reducing development time and development costs.

The logical decision unit comprises the first comparator and the XOR gate. Most of the comparing units generally output the low level signal, thus the sum of the output voltage of all comparing units is small, and is less than the second reference voltage (namely the preset reference value), the first comparator outputs the low level signal. At this time, the comparing unit corresponding to the normal LED light bar also outputs the low level signal, because the logical operations of two input signals of the XOR gate are same, the XOR gate outputs the low level signal, thus the switching unit corresponding to the normal LED light bar turns on, the LED light bar is in normal operation. When one or more LED light bar are abnormal, the voltages of the abnormal LED lights far exceed the voltages of the normal LED light bars, most of the comparing units output the high level signal, thus the sum of the output voltage of all comparing units is great, and is greater than the second reference voltage (namely the preset reference value), the first comparator outputs the high level signal. At this time, the comparing unit corresponding to the normal LED light bar also outputs the high level signal, because the logical operation of two input signals of the XOR gate are same, the XOR gate outputs the low level signal, thus the switching unit corresponding to the normal LED light bar turns on, the LED light bar is in normal operation. When the XOR gate outputs the low level signal the first controllable switch and the second controllable switch of the corresponding driving unit turn off, the switching unit receives the PWM dimming signal of the LED backlight driving circuit through the fifth resistor to dim, the corresponding LED light bar is in normal operation. When the XOR gate outputs the high level signal, the first controllable switch and the second controllable switch of the corresponding driving unit turns on, the voltage of the PWM dimming signal of the LED backlight driving circuit reduces, the corresponding switching unit is driven to turn off, and the corresponding LED light bar turns off.

It should be understood that the counting unit of the statistic unit is not used, and the logic state output by the comparing unit is directly read by an intelligent chip, such as microcontroller. The comparing units are divided into two groups according to the logic state, and the intelligent chip turns off the LED light bars corresponding to one of two groups of comparing units having a fewer number than the other group of the LED light bars.

Example 2

Figure 5:
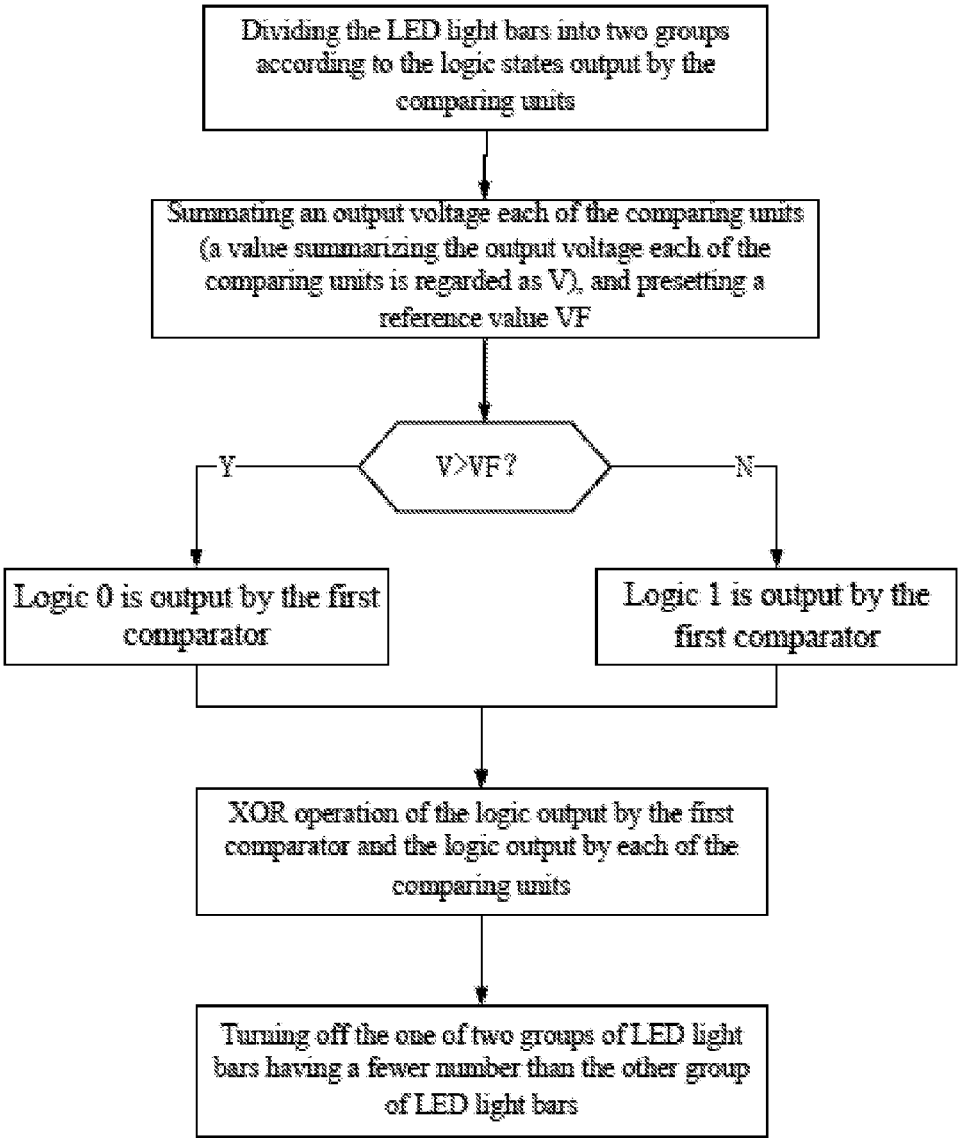
FIG. 5 is a flowchart of a method for driving a light emitting diode (LED) backlight driving circuit of a second example of the present disclosure.

As shown in FIG. 5, the present disclosure provides a method for driving a light emitting diode (LED) backlight driving circuit, the LED backlight driving circuit comprises a plurality of LED light bars, the power supply that drives the LED light bars, and the comparing units corresponding to the LED light bars one by one. The first input end of the comparing unit is coupled to the cathode end of the LED light bar, and a second input end of the comparing unit receives the first reference voltage. Each of the LED light bars is connected in series with the switching unit, the method comprises:

A: determining logic states output by all comparing units, and dividing the LED light bars into two groups according to the logic states output by the comparing units.

B: turning off one of two groups of LED light bars having a fewer number than the other group of the LED light bars.

The step A further comprises: summing an output voltage of each of the comparing units (a value summing the output voltage of each of the comparing units is regarded as V), presetting a reference value (VF), and comparing the value V with the reference value VF through the first comparator. When the value V exceeds the reference value VF, logic output by the first comparator and logic output by the one group of comparing unit having few LED light bars are same (the logic is regarded as 0). When the value V does not exceed the reference value VF, logic output by the first comparator and logic output by the one group of comparing unit having more LED light bars are same (the logic is regarded as 1). The step B comprises: driving a corresponding switching unit after XOR operation of the logic output by the first comparator and the logic output by each of the comparing units, and turning off the one of two groups of LED light bars having a fewer number than the other group of the LED light bars. When the voltages of a few LED light bars are great, and far exceed the voltages of remaining normal LED light bars, most of the comparing units output a high level signal, at this time, a sum of the output voltages of all comparing units is great. The reference value is set, when the sum of the output voltages of all comparing units exceeds the reference value, the logic output by the first comparator and the logic output by the one group comparing unit having few LED light bars are same, and the corresponding switching unit is driven after the XOR operation of the logic output by the first comparator and the logic output by the one group comparing unit having few LED light bars, which turns off one of two groups of LED light bars having a fewer number than the other group of the LED light bars.

It should be understood that a counting unit of a statistic unit is not used, and the logic state output by the comparing unit is directly read by an intelligent chip, such as microcontroller. The comparing units are divided into two groups according to the logic state, and the intelligent chip turns off the LED light bars corresponding to one of two groups of comparing units having a fewer number than the other group of the LED light bars.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driving circuit, comprising:

a plurality of LED light bars;

a power supply that drives the LED light bars; and comparing units corresponding to the LED light bars one by one;

wherein a first input end of each of the comparing units is coupled to a cathode end of the LED light bars, a second input end of each of the comparing units receives a first reference voltage; each of the LED light bars is connected in series with switching units, an output end of each of the comparing units is coupled to a statistic unit; an output end of the statistic unit is coupled to a plurality of driving units corresponding to the switching units one by one, and the driving units control the switching units to turn on/off;

the statistic unit divides the LED light bars into two groups according to logic state output by each of the comparing units, and controls each of the driving units to turn off one of two groups of LED light bars having a fewer number than the other group of the LED light bars;

wherein the statistic unit comprises a counting unit that sums an output voltage of each of the comparing units, and a logical decision unit coupled to the counting unit; when a value summing the output voltage of each of the comparing units by the counting unit exceeds a preset reference value, the logical decision unit controls each of the driving units to turn off one of two groups of LED light bars having a fewer number than the other group of the LED light bars.

2. The LED backlight driving circuit of claim 1, wherein the logical decision unit comprises a first comparator, and an XOR gate corresponding to the LED light bar one by one; a first input end of the first comparator is coupled to the counting unit, and a second input end of the first comparator receives a second reference voltage; a value of the second reference voltage is equal to the preset reference value; a first input end of the XOR gate is coupled to an output end of the first comparator, a second input end of the XOR gate is coupled to the output end of each of the comparing units corresponding to each of the LED light bars, and an output end of the XOR gate is coupled to each of the driving units.

3. The LED backlight driving circuit of claim 2, wherein each of the driving units comprises a first controllable switch, a second controllable switch, a fourth resistor, and a fifth resistor; an input end of the first controllable switch receives a reference high level signal, a control end of the first controllable switch is coupled to a corresponding each of the comparing units, and an output end of the first controllable switch is connected with a ground terminal through the fourth resistor; an output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor.

4. The LED backlight driving circuit of claim 1, wherein the counting unit comprises an adder, and an inverter coupled to the adder; an input end of the adder is coupled to the output end of each of the comparing units, and the inverter is coupled to the logical decision unit.

5. The LED backlight driving circuit of claim 4, wherein the logical decision unit comprises a first comparator, and an XOR gate corresponding to the LED light bar one by one; a first input end of the first comparator is coupled to the counting unit, and a second input end of the first comparator receives a second reference voltage; a value of the second reference voltage is equal to the preset reference value; a first input end of the XOR gate is coupled to an output end of the first comparator, a second input end of the XOR gate is coupled to the output end of each of the comparing units corresponding to each of the LED light bars, and an output end of the XOR gate is coupled to each of the driving units.

6. The LED backlight driving circuit of claim 5, wherein each of the driving units comprises a first controllable switch, a second controllable switch, a fourth resistor, and a fifth resistor; an input end of the first controllable switch receives a reference high level signal, a control end of the first controllable switch is coupled to a corresponding each of the comparing units, and an output end of the first controllable switch is connected with a ground terminal through the fourth resistor; an output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor.

7. The LED backlight driving circuit of claim 4, wherein the adder comprises a first amplifier, each of the comparing units is coupled to an inverting input end of the first amplifier through a divider resistor, and resistance value of each of the divider resistors is same; a first resistor is connected between the inverting input end of the first amplifier and an output end of the first amplifier, and a resistance value of the first resistor is equal to a sum of resistance values of all divider resistors;

the inverter comprises a second amplifier, a second resistor, and a third resistor, resistance value of the second resistor and resistance value of the third resistor are same; the output end of the first amplifier of the adder is coupled to an inverting input end of the second amplifier through the second resistor, the third resistor is connected between the inverting input end of the second amplifier and an output end of the second amplifier, and the output end of the second amplifier is coupled to the logical decision unit.

8. The LED backlight driving circuit of claim 7, wherein the logical decision unit comprises a first comparator, and an XOR gate corresponding to the LED light bars one by one; a first input end of the first comparator is coupled to the counting unit, and a second input end of the first comparator receives a second reference voltage; a value of the second reference voltage is equal to the preset reference value; a first input end of the XOR gate is coupled to an output end of the first comparator, a second input end of the XOR gate is coupled to the output end of each of the comparing units corresponding to each of the LED light bars, and an output end of the XOR gate is coupled to each of the driving units.

9. The LED backlight driving circuit of claim 8, wherein each of the driving units comprises a first controllable switch, a second controllable switch, a fourth resistor, and a fifth resistor; an input end of the first controllable switch receives a reference high level signal, a control end of the first controllable switch is coupled to a corresponding each of the comparing units, and an output end of the first controllable switch is connected with a ground terminal through the fourth resistor; an output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor.

10. The LED backlight driving circuit of claim 1, wherein the statistic unit comprises a counting unit that sums an output voltage of each of the comparing units, and a logical decision unit coupled to the counting unit; the counting unit comprises an adder, and an inverter coupled to the adder; an input end of the adder is coupled to the output end of each of the comparing units, and the inverter is coupled to the logical decision unit;

the adder comprises a first amplifier, each of the comparing units is coupled to an inverting input end of the first amplifier through a divider resistor, and resistance value of each of the divider resistors is same; a first resistor is connected between the inverting input end of the first amplifier and an output end of the first amplifier, and a resistance value of the first resistor is equal to a sum of resistance values of all divider resistors;

the inverter comprises a second amplifier, a second resistor, and a third resistor, resistance value of the second resistor and resistance value of the third resistor are same; the output end of the first amplifier of the adder is coupled to an inverting input end of the second amplifier through the second resistor, the third resistor is connected between the inverting input end of the second amplifier and an output end of the second amplifier, and the output end of the second amplifier is coupled to the logical decision unit;

the logical decision unit comprises a first comparator, and an XOR gate corresponding to the LED light bar one by one; a first input end of the first comparator is coupled to the output end of the second amplifier, and a second input end of the first comparator receives a second reference voltage; a first input end of the XOR gate is coupled to an output end of the first comparator, a second input end of the XOR gate is coupled to the output end of each of the comparing units corresponding to each of the LED light bars;

each of the driving units comprises a first controllable switch, a second controllable switch, a fourth resistor, and a fifth resistor; an input end of the first controllable switch receives a reference high level signal, a control end of the first controllable switch is coupled to a corresponding each of the comparing units, and an output end of the first controllable switch is connected with a ground terminal through the fourth resistor; an output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor;

when an output voltage of the first amplifier is less than a preset reference value, the first comparator outputs a high level signal to control the second controllable switch corresponding to one of two groups of LED light bars having a fewer number than the other group of the LED light bars to turn on through the XOR gate; a value of the second reference voltage is equal to the preset reference value.

11. A light emitting diode (LED) backlight driving circuit, comprising:

a plurality of LED light bars;

a power supply that drives the LED light bars; and comparing units corresponding to the LED light bars one by one;

wherein a first input end of each of the comparing units is coupled to a cathode end of the LED light bar, a second input end of each of the comparing units receives a reference voltage; each of the LED light bars is connected in series with a switching units, an output end of each of the comparing units is coupled to a statistic unit; an output end of the statistic unit is coupled to a plurality of driving units corresponding to the switching units one by one, and the driving units control the switching units to turn on/off;

the statistic unit divides the LED light bars into two groups according to logic state output by each of the comparing units, and controls each of the driving units to turn off one of two groups of LED light bars according to a preset condition;

wherein the statistic unit comprises a counting unit that sums an output voltage of each of the comparing units, and a logical decision unit coupled to the counting unit; when a value resulting from summing the output voltage of each of the comparing units by the counting unit exceeds a preset reference value, the logical decision unit controls the driving unit to turn off one of two groups of LED light bars having a fewer number than the other group of the LED light bars.

12. The LED backlight driving circuit of claim 11, wherein the counting unit comprises an adder, and an inverter coupled to the adder; an input end of the adder is coupled to the output end of each of the comparing units, and the inverter is coupled to the logical decision unit.

13. The LED backlight driving circuit of claim 12, wherein the adder comprises a first amplifier, each of the comparing units is coupled to an inverting input end of the first amplifier through a divider resistor, and resistance value of each of the divider resistors is same; a first resistor is connected between the inverting input end of the first amplifier and an output end of the first amplifier, and a resistance value of the first resistor is equal to a sum of resistance values of all divider resistors;

the inverter comprises a second amplifier, a second resistor, and a third resistor, resistance value of the second resistor and resistance value of the third resistor are same; the output end of the first amplifier of the adder is coupled to an inverting input end of the second amplifier through the second resistor, the third resistor is connected between the inverting input end of the second amplifier and an output end of the second amplifier, and the output end of the second amplifier is coupled to the logical decision unit.

14. The LED backlight driving circuit of claim 13, wherein the logical decision unit comprises a first comparator, and an XOR gate corresponding to the LED light bars one by one; a first input end of the first comparator is coupled to the counting unit, and a second input end of the first comparator receives a second reference voltage; a value of the second reference voltage is equal to the preset reference value; a first input end of the XOR gate is coupled to an output end of the first comparator, a second input end of the XOR gate is coupled to the output end of each of the comparing units corresponding to each of the LED light bars, and an output end of the XOR gate is coupled to each of the driving units.

15. The LED backlight driving circuit of claim 14, wherein each of the driving units comprises a first controllable switch, a second controllable switch, a fourth resistor, and a fifth resistor; an input end of the first controllable switch receives a reference high level signal, a control end of the first controllable switch is coupled to a corresponding each of the comparing units, and an output end of the first controllable switch is connected with a ground terminal through the fourth resistor; an output end of the second controllable switch is connected with the ground terminal, a control end of the second controllable switch is coupled to an output end of a corresponding first second controllable switch, and an input end of the second controllable switch receives a pulse-width modulation (PWM) dimming signal of the LED backlight driving circuit through the fifth resistor.

16. A method for driving a light emitting diode (LED) backlight driving circuit, the LED backlight driving circuit comprising a plurality of LED light bars, a power supply that drives the LED light bars, and comparing units corresponding to the LED light bars one by one; a first input end of each of the comparing units coupled to a cathode end of the LED light bar, a first reference voltage input to a second input end of each of the comparing units, and each of the LED light bars connected in series with a switching units; the method comprising:

A: determining logic states output by all the comparing units, and dividing the LED light bars into two groups according to the logic states output by the comparing units; and B: turning off one of two groups of LED light bars having a fewer number than the other group of the LED light bars;

wherein the step A comprises:

summing an output voltage each of the comparing units, presetting a reference value, and comparing the reference value with a value summing the output voltage each of the comparing units through the first comparator;

when the value summing the output voltage each of the comparing units exceeds the reference value, logic output by the first comparator and logic output by the one group of comparing unit having few LED light bars are same; when the value summing the output voltage each of the comparing units does not exceed the reference value, logic output by the first comparator and logic output by the one group of comparing unit having more LED light bars are same;

the step B comprises:

driving a corresponding switching unit after XOR operation of the logic output by the first comparator and the logic output by each of the comparing units, and turning off the one of two groups of LED light bars having a fewer number than the other group of the LED light bars.

* * * * *